US005810364A

United States Patent [19]

Canion

[11] Patent Number: 5,810,364

[45] Date of Patent: Sep. 22, 1998

[54] SUNKEN TREASURE CHEST

[76] Inventor: Heidi Canion, 905 Iris Dr., Georgetown, Tex. 78626

[21] Appl. No.: 901,420

[22] Filed: Jul. 28, 1997

[51] Int. Cl.[6] ..... A63B 67/00

[52] U.S. Cl. ..... 273/459; 273/440; 273/447; 473/466; 446/153

[58] Field of Search ..... 273/459, 440, 273/447; 472/128; 446/73, 75, 166, 167, 153; 434/254; 220/603; 473/466; 224/934; 405/186; 190/19; 206/811, 457, 315.1; 119/253

[56] References Cited

U.S. PATENT DOCUMENTS

| | | | |
|---|---|---|---|
| D. 334,662 | 4/1993 | van Berne . | |
| D. 347,324 | 5/1994 | Dickinson . | |
| 3,499,647 | 3/1970 | Nestler | 273/447 X |
| 3,707,289 | 12/1972 | Wicks | 273/440 X |
| 3,773,015 | 11/1973 | Cruickshank et al. | 416/153 X |
| 4,050,697 | 9/1977 | Purviance . | |
| 4,103,455 | 8/1978 | Silvey | 446/73 |
| 4,779,554 | 10/1988 | Courtney | 405/186 X |
| 4,872,582 | 10/1989 | Sipple | 220/603 |
| 4,944,401 | 7/1990 | Groenewegen | 206/811 X |
| 5,067,855 | 11/1991 | Kamitani | 405/186 |
| 5,248,153 | 9/1993 | Jones . | |
| 5,281,144 | 1/1994 | Pease . | |
| 5,429,541 | 7/1995 | Landon | 446/75 X |

*Primary Examiner*—Raleigh W. Chiu
*Attorney, Agent, or Firm*—James E. Bradley

[57] ABSTRACT

A swimming pool search and retrieval game comprising a toy treasure chest and toy treasure pieces is provided. The chest is made from ornately styled waterproof plastic in the form of a sunken treasure chest. The chest has a lid, a lock, a key, and a compartment which contains sand to keep the chest weighted down while it is submerged. The chest contains an assortment of nonbuoyant toy treasure pieces that are also made from ornately styled waterproof plastic. The treasure pieces include jewelry, coins and trinkets. The treasure pieces are placed inside the treasure chest and the treasure chest is sunk to the bottom of a swimming pool. A player swims to the sunken chest and retrieves a treasure piece. The player returns to the surface of the pool with the retrieved item and repeats the sequence until all of the treasure pieces and the treasure chest are retrieved.

10 Claims, 1 Drawing Sheet

SUNKEN TREASURE CHEST

BACKGROUND OF THE INVENTION

1. Field of the Invention

The invention relates in general to games and in particular to a swimming pool retrieval game.

2. Description of the Prior Art

Prior art toy treasure chests have been used for recreational games to be played on land. Typically, prior art toy treasure chests and their accompanying toy treasure pieces are made from plastic or similar lightweight material. These types of prior art toy treasure chests and pieces are not suitable for use as a swimming pool game. The chests and pieces are too buoyant or lightweight to be readily sunk in a swimming pool. Other prior art toy treasure chests and toy treasure pieces are too large or cumbersome for children to easily manipulate, especially for a swimming pool underwater search and retrieval game.

Further, prior art toy treasure chests and toy treasure pieces do not require a player to perform much physical exertion to search for and gather the toy treasure pieces. For a swimming pool underwater search and retrieval game, it is desirable to require that a player swim between distal positions to require physical assertion.

SUMMARY OF THE INVENTION

A swimming pool underwater search and retrieval game comprising a toy treasure chest and toy treasure pieces is provided. The chest is made from ornately styled waterproof plastic in the form of a traditional sunken treasure chest. The chest has a hinged lid and a simulated lock with a key. The chest also has a compartment which contains sand to keep the chest weighted down while it is submerged. The chest contains an assortment of nonbuoyant toy treasure pieces that are made from ornately styled waterproof plastic in the form of sunken treasure chest items. The treasure pieces include jewelry, coins and other trinkets. Each treasure piece is visually different from the other pieces, whether by shape, size or color. The treasure pieces and the treasure chest are small and lightweight enough to be easily grasped in a child's hands. A small bag may be used to collect the treasure pieces.

To play the game, the treasure pieces are placed inside the treasure chest and the chest is sunk to the bottom of a swimming pool. A player swims and dives down to the sunken chest. The lid is raised and at least one treasure piece is retrieved from the chest. The player returns to the surface of the swimming pool with the retrieved treasure piece and repeats the sequence until all of the treasure pieces and the chest are retrieved.

DETAILED DESCRIPTION OF THE PREFERRED EMBODIMENT

Figure 1:
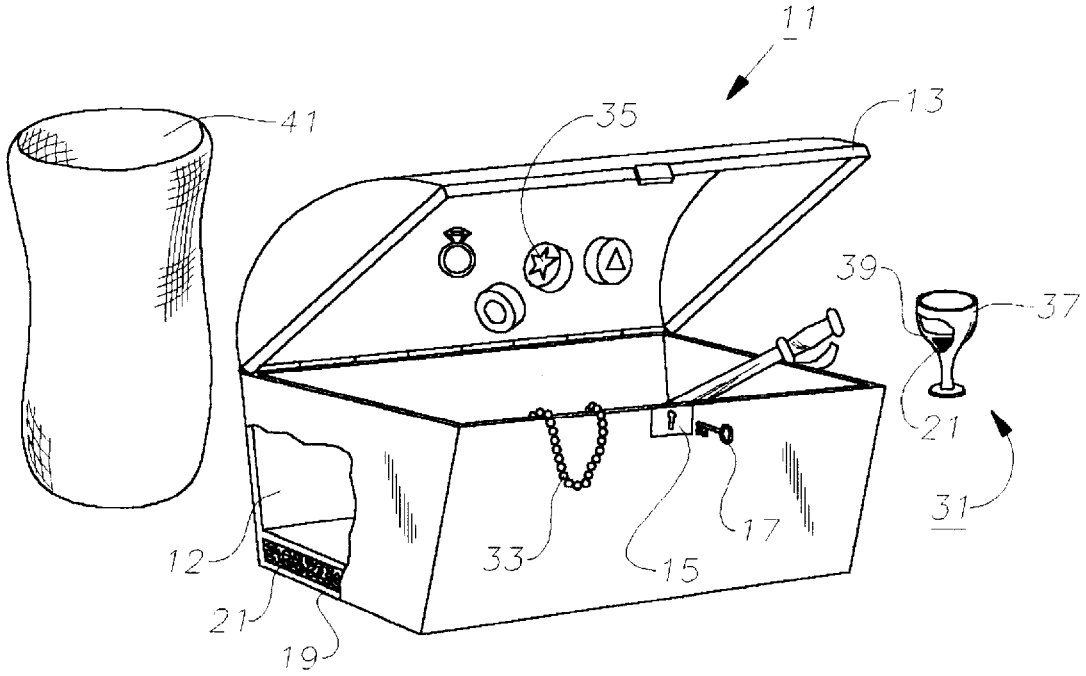
FIG. 1 is a schematic isometric drawing of an apparatus constructed in accordance with the invention.

Referring to FIG. 1, a toy treasure chest 11 is shown. Chest 11 is made from ornate waterproof plastic in the form of a sunken treasure chest. The exterior of chest 11 is generally styled like traditional wooden treasure chests, while the interior of chest 11 comprises a rectangular opening 12. Chest 11 has a fully functioning hinged lid 13 and a simulated lock 15 with a key 17. Chest 11 is small and lightweight enough to be easily manipulated by a child and measures roughly one foot wide by 10 inches high by 10 inches deep. Chest 11 has a compartment 19 which contains a weight material 21 such as sand. Weight material 21 enables chest 11 to sink in a body of water (not shown), such as a swimming pool, and keeps chest 11 weighted down while it is submerged.

Chest 11 contains an assortment of nonbuoyant toy treasure pieces 31. Treasure pieces 31 are made from ornately styled waterproof plastic in the form of sunken treasure chest items. Treasure pieces 31 comprise jewelry 33, coins 35 and trinkets 37. Each treasure piece 31 is visually different from the other pieces 31, whether by shape, size or color. Treasure pieces 31 are small and lightweight enough to be easily grasped in a child's hand. Alternatively, treasure pieces 31 may be manufactured with a compartment 39 which contains a weight material 21 such as sand to decrease the buoyancy of treasure pieces 31. A small bag 41 is used to collect treasure pieces 31.

In operation, treasure pieces 31 are placed inside treasure chest 11 and chest 11 is sunk to the bottom of a swimming pool. A player swims and dives down to sunken chest 11. If lock 15 is not open, the player inserts key 17 into lock 15 to open it. Lid 13 is raised and at least one treasure piece 31 is retrieved from chest 11. The player returns to the surface of the swimming pool with retrieved treasure piece 31. This sequence is repeated until all treasure pieces 31 and chest 11 are retrieved. Alternatively, the player may swim and dive to chest 11 with bag 41 to collect one or more treasure pieces 31 during each dive.

The invention has several advantages. The game is designed to be easily sunk and retrieved from a body of water such as a swimming pool. The game may be used to help players learn how to swim and dive, or simply for recreational swimming. In either case, the game offers players more physical exertion than prior art land-based toy treasure chest games. The game is designed to be relatively inexpensive and it is small and lightweight enough to be easily manipulated by children.

While the invention has been shown in only one of its forms, it should be apparent to those skilled in the art that it is not so limited, but is susceptible to various changes without departing from the scope of the invention.

I claim:

1. A game apparatus, comprising:

a toy treasure chest having a trunk, a lid, and a compartment that contains a ballast which provides a negative buoyancy for the toy treasure chest for submersion in a swimming pool; and toy treasure items located within the toy treasure chest for retrieval from a swimming pool, each of the toy treasure items having a negative buoyancy.

2. The game apparatus according to claim 1 wherein the toy treasure chest and the toy treasure items have a waterproof plastic cover.

3. The game apparatus according to claim 1 wherein the ballast comprises sand.

4. The game apparatus according to claim 1, further comprising:

a lock on the treasure chest; and a key for opening the lock on the treasure chest.

5. A game apparatus directed to retrieving objects from the bottom of a swimming pool, comprising:

a waterproof toy treasure chest having a main compartment, a hinged lid, a lock, a key, and an auxiliary compartment;

a ballast material contained in the auxiliary compartment in an amount sufficient to sink the chest in the swimming pool; and A plurality of waterproof toy treasure pieces, the treasure pieces having a ballast compartment containing a ballast material in an amount sufficient to make the treasure pieces nonbuoyant, the treasure pieces being located within the main compartment of the treasure chest for retrieval by swimming and diving to the treasure chest.

6. The game apparatus according to claim 5 wherein the toy treasure chest and the toy treasure pieces are plastic.

7. The game apparatus according to claim 5 wherein the ballast material comprises sand.

8. The game apparatus according to claim 5 further comprising a sack for holding the toy treasure items during retrieval.

9. A method of playing a game comprising the steps of:

a. providing a nonbuoyant, waterproof toy treasure chest having a trunk and a lid;

b. providing nonbuoyant, waterproof toy treasure pieces including jewelry, coins and trinkets;

c. placing the treasure pieces in the toy treasure chest;

d. sinking the treasure chest in a swimming pool;

e. swimming to and diving toward the sunken treasure chest;

f. retrieving a treasure piece from the treasure chest;

g. returning to the surface of the swimming pool with the retrieved item; and then h. repeating steps e.–g. until all of the treasure pieces and the treasure chest are retrieved.

10. The method according to claim 9, further comprising:

providing the toy treasure chest with a lock and a key; and opening the lock with the key prior to step f.

* * * * *